United States Patent [19]

Rios

[11] Patent Number: 4,979,712

[45] Date of Patent: Dec. 25, 1990

[54] TOWEL HOLDER FOR SHOWER ENCLOSURES

[76] Inventor: Wilfredo Rios, 7228 Wynfield Loop, Midland, Ga. 31820

[21] Appl. No.: 471,887

[22] Filed: Jan. 29, 1990

[51] Int. Cl.[5] ..... A47B 96/06

[52] U.S. Cl. ..... 248/215; 248/304

[58] Field of Search ..... 248/214, 215, 303, 340, 248/213, 301, 304; 211/113

[56] References Cited

U.S. PATENT DOCUMENTS

| | | | |
|---|---|---|---|
| 362,124 | 5/1887 | Thompson | 248/215 UX |
| 490,224 | 1/1893 | Campbell | 248/340 X |
| 927,483 | 7/1909 | Bradley | 248/303 |
| 1,089,882 | 3/1914 | Thomas | 248/303 X |
| 2,606,734 | 8/1952 | Magnuson | 248/215 |
| 2,936,076 | 5/1960 | Harris | 211/113 |
| 3,140,557 | 7/1964 | Albrycht | 248/340 X |
| 3,266,764 | 8/1966 | Briles | 248/213 |
| 4,027,842 | 6/1977 | Mittleman | 248/215 X |

FOREIGN PATENT DOCUMENTS

| | | | |
|---|---|---|---|
| 4932 | of 1895 | United Kingdom | 248/215 |

*Primary Examiner*—J. Franklin Foss

*Attorney, Agent, or Firm*—Thomas & Kerr

[57] ABSTRACT

A towel holder for shower enclosures and the like is disclosed, the holder having a handle portion disposed in the interior of the enclosure, a towel holding portion disposed on the exterior of the enclosure, and a connecting shank which engages an upper edge of the shower door rail, curtain rod, or an enclosure wall, such that the handle and towel holder are disposed below the level of engagement of the shank with its support.

8 Claims, 1 Drawing Sheet

TOWEL HOLDER FOR SHOWER ENCLOSURES

BACKGROUND OF THE INVENTION

A typical home shower is normally provided with a generally rigid door structure supported by top, bottom, and side rails or is provided with a rigid curtain rod which suspends a shower curtain. In order to make the enclosure waterproof from the rest of the bathroom area, the doors or curtains normally extend completely from one side of the enclosure to the other and from a point near the shower floor to a point near or above the shower head. The enclosed nature of the environment normally means that the shower enclosure itself attains a higher temperature than the rest of the bathroom. This provides a comfortable environment for taking a shower but also results in one having to move from a warm, sheltered environment to a more open, and usually colder environment to get a towel for drying oneself. Many bathrooms exacerbate this problem by having an exhaust fan which removes steam from the room while the shower is running. Such fans help in controlling mildew and other moisture-related problems but also cool the bathroom quickly.

Thus, the temperature change from one environment to the other can be quite drastic. Such a change is, at the very least, uncomfortable, and can have detrimental health effects, ranging from muscular discomfort to the creation of an environment in which a person is more susceptible to a viral infection or cold.

While in many cases, a towel rack is provided outside the shower and possibly within reaching distance, the person must usually endure the initial rush of cooler air. In opening the shower door or curtain to reach for a towel, the warmth of the shower enclosure is quickly dissipated, thus leading to the discomfort and other problems mentioned above. Where no rack is provided close to the shower and a bather has to go across the bathroom to get a towel, the possibility of slipping and consequent injury is of serious concern.

SUMMARY OF THE INVENTION

It is, therefore, one of the principal objects of the present invention to provide a towel holder for shower enclosures that engages a wall means of the shower enclosure, such as the top rail of a shower door or a curtain rod, disposing the towel outside the enclosure with a handle on the inside of the enclosure for retrieving the towel.

Another object of the present invention is to provide a towel holder which is unaffected by moisture and which easily engages or is disengaged from the support means.

A further object of the present invention is to allow a person to dry oneself within the shower enclosure without having to endure the temperature change from opening the enclosure.

A still further object of the present invention is to provide a towel holder that is inexpensive to manufacture and which is durable to provide a long service life.

These and additional objects are attained by the present invention which relates to a towel holder for shower enclosures having a handle means which extends into the enclosure, a holding means for the towel disposed outside of the enclosure, and a connecting means for the two which also engages a portion of the enclosure. The connecting means will normally engage an upper shower door rail or a curtain rod; however, in some cases, it may engage one of the shower walls, depending on the particular shower and/or bathroom design.

The present invention is formed from any suitable material, such as a rigid or flexible plastic, metal, or any of a number of suitable elastomers. The present holder allows access to the towel immediately after showering, while the shower enclosure remains closed and warm.

Various additional objects and advantages of the present invention will become apparent from the following description, with reference to the accompanying drawings.

DETAILED DESCRIPTION OF THE PREFERRED EMBODIMENT

Figure 1:
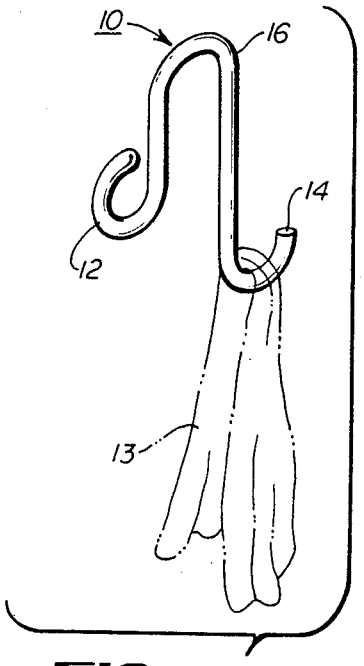
FIG. 1 is a perspective view showing a preferred embodiment of the present towel holder.

Referring now more specifically to the drawings, and to FIG. 1 in particular, numeral 10 designates generally the present towel holder for shower enclosures. The holder is normally disposed either over the top rail of a shower door, over a shower curtain holding rod, or in some cases over one of the walls of the shower enclosure, all of which can be considered wall means for the purposes of this invention. The invention includes a handle means 12, a means for holding a towel 13, such as hook 14 or a type of clamp, and means connecting the handle and hook ends, such as shank 16. The shank 16 is essentially U-shaped and has an approximate one hundred eighty degree (180°) bend intermediate the handle end and hook end for engaging the door rail, rod, etc. The present holder is thus designed so that the handle and the hook end do not contact the support means, this function being accomplished by an intermediate portion of the shank 16, in contrast to a coat or plant hanger, for example, in which a hook is engaged with the support means.

The present towel holder may be formed from a rigid or semi-rigid material, such as plastic or metal, or it may be formed from any of a number of suitable, flexible elastomers, such as vinyl or rubber. Such materials are impervious to water, humidity, and elevated temperatures, as are common in a bathroom environment, thus providing a long service life. FIG. 1 illustrates a substantially rigid or semi-rigid form of the invention while the embodiment of the holder 20 shown in FIG. 2 illustrates a more flexible model of the invention.

Referring to the embodiment shown in FIG. 1, in the use and operation of the present invention, the holder 10 will normally be stored in place between uses over the door rail or curtain rod. Thus, the user can conveniently hang the towel on the hook 14 upon entering the shower. When finished with the shower, the user grasps the handle means 12 and lifts the towel holder and towel into the shower enclosure, obviating the need to open the shower door or curtain. With a rigid or semi-rigid embodiment, as described and illustrated in FIG. 1, the shank may also be used as a lever, to bring the towel over the supporting door, rod, or wall means.

Figure 2:
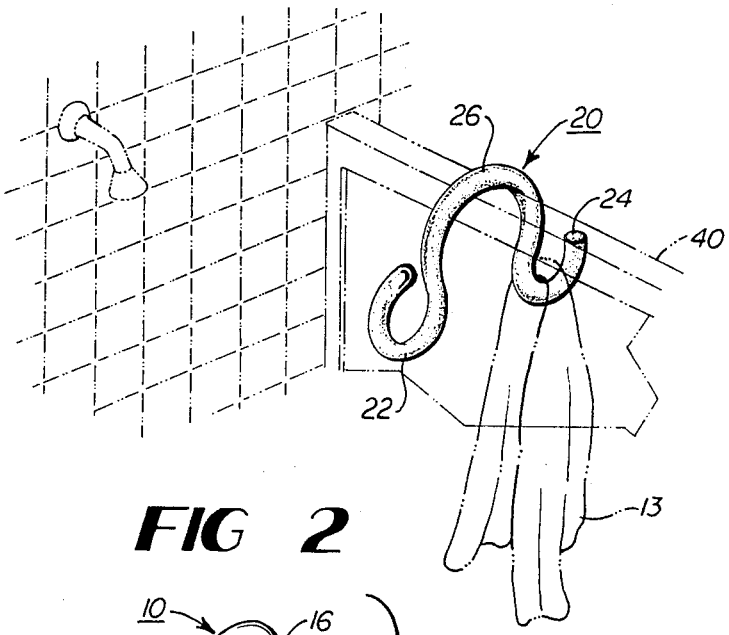
FIG. 2 is a partial perspective view showing an alternate embodiment of the present towel holder, shown in place over a shower enclosure door.
Figure 3:
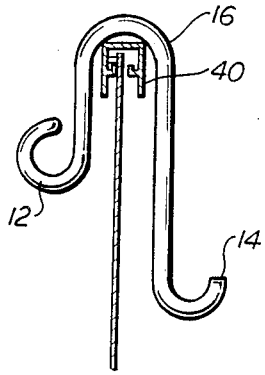
FIG. 3 is a partial side elevational and cross-sectional view illustrating the engagement of the present holder with the support means.

The construction and use of the alternate towel holder embodiment 20, shown in FIG. 2, are essentially similar to that described for the first embodiment. Holder 20 includes a handle means 22, a towel holding means such as hook 14, and means connecting the handle and hook, such as shank 16. As in the first embodiment, the shank is designed to suspend the handle and the hook below the level of the engagement of the shank with the support therefore, e.g. the rail, curtain rod, etc., as illustrated in FIG. 3. In addition, when the holder is in its operative position on the support means, the handle means and towel holding means project away from the wall means and are normally spaced therefrom, facilitating the use thereof in that it is easy to hang a towel on the hook end and easy to grasp the handle end for disengaging the holder from its support.

It is also considered to be within the scope of the present invention to provide a plurality of towel holding means, such as multiple hooks, for example. In addition, the towel holding means can be formed as a ring or as a towel rack, having a rod upon which the towel may be hung for drying after use.

Thus, while an embodiment of a towel holder for shower enclosures and modifications thereof have been shown and described in detail herein, various additional changes and modifications may be made without departing from the scope of the present invention.

I claim:

1. A towel holder adapted to be mounted over an upper edge of shower enclosures, shower curtain rods and the like, said holder comprising a handle means disposed in the interior of the shower enclosure, said handle means being adapted to be grasped by a user for pulling said holder over the upper edge of the shower enclosure, a shank porion of generally U-shaped configuration connected to said handle means at one end thereof, said shank portion designed for selectively engaging the upper edge of the shower enclosure and being spaced from the side wall of said shower enclosure for facilitating disengagement therefrom, and a hook means connected to and extending from said shank portion and disposed on the exterior of said shower enclosure, said hook means having a generally semicircular configuration for holding a towel while said holder is engaged with the shower enclosure and through the disengagement thereof when said holder is pulled into the shower enclosure by the user.

2. A towel holder as defined in claim 1 in which said holder is formed from a substantially rigid material and said hook means is disposed between said handle means when said holder is engaged with the upper edge of the shower enclosure or the like.

3. A towel holder as defined in claim 1 in which said holder is formed from an elastomeric material.

4. A towel holder adapted to be mounted on shower enclosures and the like, said enclosures being defined by wall means and a door means with upper edge portions serving as support means for said holder, said holder comprising a handle means disposed in the interior of the enclosure for use in pulling said holder over the upper edge portions of the enclosure, an elongated shank of generally U-shaped configuration with one end thereof being connected to said handle means, said shank designed to selectively engage an upper edge portion of the enclosure and to be easily disengaged therefrom, and a towel holding means connected to the other end of said shank and disposed on the exterior of the enclosure, said towel holding means being semicircular for retaining a towel thereon while said holder is suspended over the upper edge of the enclosure and during the time the holder is pulled into the enclosure by the user thereof, said towel holding means being disposed at a first level while engaged with the upper edge of the enclosure and said handle means being disposed at a level above said towel holding means relative thereto.

5. A towel holder as defined in claim 4 in which said holder is comprised of a rigid material, such that the user may utilize said shank as a level against the upper edge of the enclosure to bring the towel into the enclosure within leaving the enclosure.

6. A towel holder as defined in claim 4 in which said holder is formed from an elastomeric material.

7. A towel holder as defined in claim 4 in which said shank is of configuration that said handle means and towel holding means are spaced from the wall means when said shank is engaged with the wall means.

8. A towel holder as defined in claim 7 in which said shank has an approximate curvature of less than 200°.

* * * * *